US006727819B2

(12) United States Patent
Ko

(10) Patent No.: US 6,727,819 B2
(45) Date of Patent: Apr. 27, 2004

(54) POOL GUARD ALARM

(76) Inventor: Joseph Y. Ko, 12 Morning Dove, Laguna Niguel, CA (US) 92677

( * ) Notice: Subject to any disclaimer, the term of this patent is extended or adjusted under 35 U.S.C. 154(b) by 0 days.

(21) Appl. No.: 10/179,621

(22) Filed: Jun. 24, 2002

(65) Prior Publication Data

US 2003/0234728 A1 Dec. 25, 2003

(51) Int. Cl.[7] ..... G08B 23/00
(52) U.S. Cl. ..... 340/573.6; 340/547; 340/509.15
(58) Field of Search ..... 340/309.15, 573.6, 340/547, 540, 545.1

(56) References Cited

U.S. PATENT DOCUMENTS 4,278,968 A * 7/1981 Arnett et al. ..... 340/686.6
4,335,376 A 6/1982 Marquardt
4,851,814 A 7/1989 Rehberg
4,920,333 A 4/1990 Barr et al.
5,289,534 A 2/1994 Lester et al.
5,434,556 A * 7/1995 Donohoo ..... 340/547
5,473,310 A 12/1995 Ko
5,751,214 A * 5/1998 Cowley et al. ..... 340/573.4
5,786,761 A * 7/1998 Hui ..... 340/547
6,014,077 A * 1/2000 Beaumont et al. ..... 340/545.1
6,114,963 A * 9/2000 Blake et al. ..... 340/573.4

* cited by examiner

*Primary Examiner*—Nina Tong
(74) *Attorney, Agent, or Firm*—Knobbe, Martens, Olson & Bear, LLP

(57) ABSTRACT

A pool guard alarm provides constant security at one or more entrances to a pool area. The alarm utilizes a delay timer to provide an authorized entrant the ability to enter the pool area and reset the alarm before an audible alarm is sounded. The alarm further guards against pool entrances being left inadvertently open by sounding an audible alarm if a pool access point is not closed within a specified time period after being opened.

14 Claims, 5 Drawing Sheets

POOL GUARD ALARM

BACKGROUND OF THE INVENTION

1. Field of the Invention

The pool guard alarm of the present invention relates generally to the field of entry alarms, and, in particular, to a gate, door, or window alarm for use at a pool to ensure younger children do not access the pool area without proper supervision.

2. Description of the Related Art

Pools can be dangerous, especially for young children who often wander into pool areas unattended. In an attempt to prevent this dangerous situation, many pool owners are required to install security measures on pool access points. Ideally, pools are kept safe by trained life guards, however, this is not always a feasible option. In the alternative, most residential and public pools are usually guarded by a fence that has one or more gates. The gates usually have some sort of security, such as a lock. Only adults or older children are given the keys to open the locks for entrance to the pool area. Problems arise, however, from misplaced keys and the inventory control required to account for each key can pose difficulties. Furthermore, the gate or door may be inadvertently left open after authorized entry, thereby allowing unauthorized use or entry by small, unattended children.

An additional prior method utilizes an alarm system designed to secure a single point of pool access. An example of such a device is my prior application entitled "Pool Guard Alarm" issued as U.S. Pat. No. 5,473,310, in which an alarm device is disclosed that allows entry to a pool area and then subsequently requires an entrant to reset the alarm system within a specified time period before an audible alarm sounds alerting others that unauthorized access has occurred. The alarm is powered by a 9V battery, which allows the alarm to be located independent of an electrical outlet. This system is effective at alerting adults to the unauthorized opening of a single point of pool entry.

While the devices described above offer a modicum of security, they are each only capable of securing a single point of pool entry. Typically, residential pools often have multiple points of entry, such as outside gates, doors leading from the residence, and house windows that all provide access to a pool area. Moreover, with respect to the alarm device described, battery power is used which may not alert of unauthorized entry if the battery is not replaced regularly.

SUMMARY OF THE INVENTION

The pool guard alarm of the present invention advantageously provides a sensor for detecting when a point of pool access has been opened, a delay timer connected to the sensor, an audio emitter connected to the timer, a power source, a reset switch, and a housing to contain the aforesaid components. The alarm is configured to detect the opening of a pool access point and activate an audible signal unless certain conditions are met.

The alarm sensor may include a magnet and a magnet sensor to detect the presence or absence of the magnet. The alarm may further have circuitry having preprogrammed instructions for receiving a signal from the sensor, activating the delay timer, and activating the audio emitter. The sensor may be connected to the delay timer by conductive wires, or wirelessly, such as through wireless transmissions. The delay timer may be configured to detect the passing of a predetermined amount of time, such as between about 5 and 20 seconds, and in some embodiments, 10 seconds. The housing, in some embodiments, is preferably constructed of an ultraviolet and water resistant plastic to withstand an outdoor pool environment. The power source may be any suitable power source, such as household current. The alarm may further be configured with a plurality of sensors for detecting the opening of a plurality of pool access points. The sensors may be wired in series or parallel with one another and with the circuitry. An optional external siren may be provided to emanate an additional audible signal.

According to another aspect, a pool guard alarm comprises a plurality of sensors configured to detect the opening of a corresponding point of pool entry. A delay timer is operatively coupled to the plurality of sensors and an audio emitter is coupled to the delay timer. A power source is provided to supply power to the aforementioned alarm components. A reset switch is further provided to reset the delay timer. The components mentioned above are housed in a housing. The alarm is configured to detect the opening of a pool access point and activate an audible signal unless certain conditions are met.

According to yet another aspect, a method of guarding a pool area from unauthorized entry in which an alarm system is provided having an audio emitter configured to emit an audible alarm. A sensor is located at each pool entry point and coupled to the alarm. The sensors are configured to sense when a pool entry point has been opened and send a corresponding signal to the alarm, which is powered by AC current. Once the opening of a pool access point has been detected, an alarm time delay device counts a predetermined amount of time. Upon the passing of the predetermined amount of time, an audible alarm is sounded unless the delay timer has been reset and the pool entry point has been closed.

Further advantages and applications will become apparent to those skilled in the aft from the following detailed description and the drawings referenced herein.

DETAILED DESCRIPTION OF PREFERRED EMBODIMENTS

Figure 1:
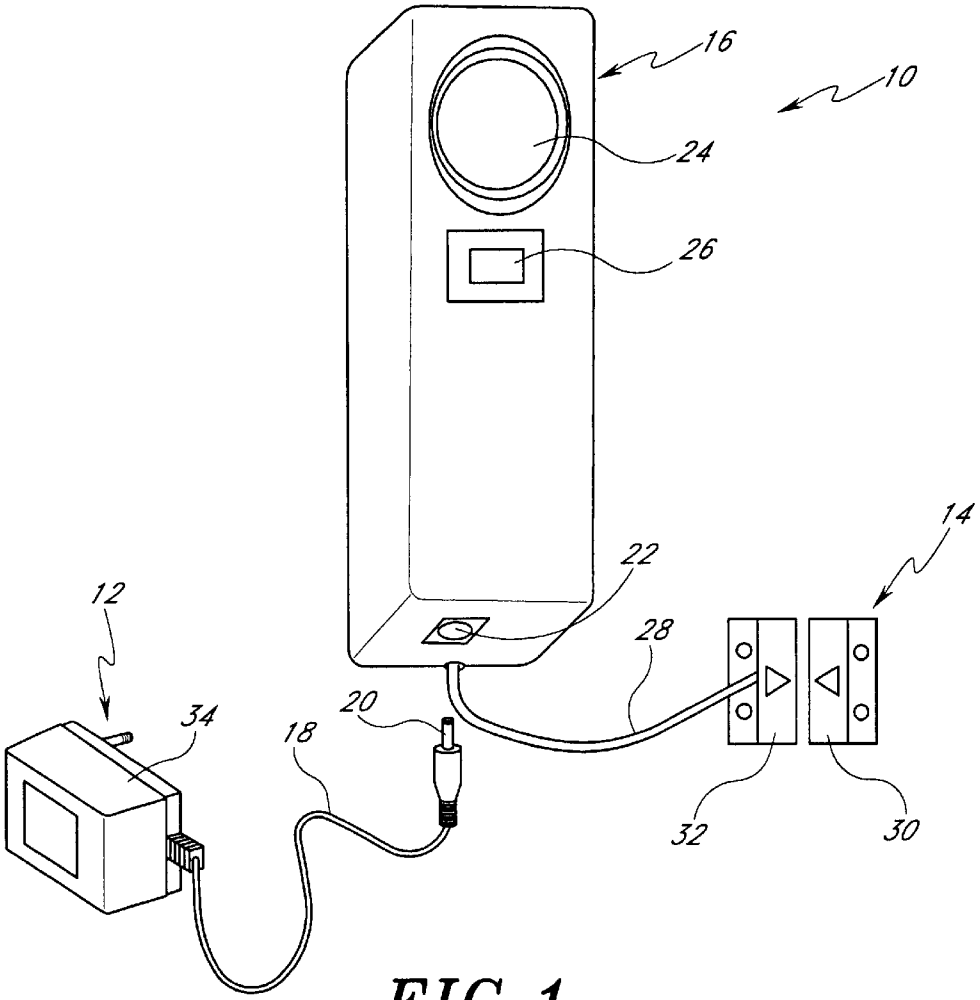
FIG. 1 illustrates one embodiment of a pool guard alarm having a single sensor and powered by an AC/DC converter.

A pool guard alarm 10 is shown in FIG. 1 and generally comprises a power source 12, a sensor 14, and a housing unit 16. In one embodiment, the power source 12 is an AC/DC converter 34 that is configured to be plugged into a standard household electrical outlet as is generally known in the art. In one embodiment, the power converter 34 receives 110VAC which it converts to 12VDC. In another embodiment, the power converter 34 outputs 9VDC. Of course, the power converter 34 could receive alternative inputs, such as 220VAC, and convert to alternative outputs without departing from the scope hereof. The aforementioned specific power inputs and outputs are illustrative only and should not be construed as limiting. In the illustrated embodiment of FIG. 1, it is anticipated that the power consuming components will require about 9VDC at about 100 mA of current draw, and therefore, the power converter 34 is configured accordingly.

The power converter 34 transmits the output power through a wire 18 that terminates in a plug 20. There is a cooperating power input jack 22 formed in the housing unit that receives the plug 20 and transmits the power output from the power converter 12 to circuitry contained within the housing unit 16. The housing unit 16 further includes an internal siren 24 or speaker and a reset switch 26. The internal siren 24 or speaker is configured to sound an audible alarm in response to logic conditions, as will be discussed in greater detail hereinafter. The reset switch 26 is integrally associated with the logic conditions that control whether the audible alarm is sounded.

One or more sensors 14 are coupled to the housing unit, either by a sensor wire 28 as illustrated, or the one or more sensors 14 may be coupled via wireless transmissions, such as radio frequency ("RF") or infrared ("IR") signals. In an embodiment in which the sensors 14 are coupled wirelessly, it is anticipated that each sensor will have its own power source, such as from a battery. Other suitable methods of coupling the sensor 14 to the housing unit 16 are possible and contemplated herein. In the illustrated embodiment, a wire 28 delivers power to the sensor 14 and transmits signals from the sensor 14 to the circuitry within the housing unit 16. As is further illustrated, one embodiment of a sensor 14 comprises a magnet 30 and a switch 32.

During installation, the magnet 30 is preferably mounted on a movable surface, such as a door, gate, or window, and the switch 32 is mounted in close proximity on a fixed surface, such as a wall. In this configuration, the switch 32 can detect the presence, or absence, of an adjacent magnet 30. Of course, the components could be swapped, thereby mounting the magnet 30 on a fixed surface, and the switch 32 on the movable surface. However, in the illustrated embodiment, it is preferable to mount the component coupled by a wire to the fixed surface, as described. The switch 32 and magnet 30 are generally located adjacent to one another such that the switch 32 can detect the presence of the magnet 30. In some embodiments, the switch and magnet are preferably mounted within a proximity of from about 0 inches to about 1 inch from each other.

The embodiment illustrated in FIG. 1 is designed to guard a single point of pool entry and is suited for indoor use to guard a single window or door that leads to a pool area. The power converter obviates the need for a battery which must be replaced periodically to ensure proper security. However, a battery may be present as a backup power source in case power from the power converter 34 is not available or becomes interrupted. Thus, FIG. 1 illustrates an embodiment of a pool guard that is always actively monitoring a point of pool access, and does not require any maintenance or upkeep to continue the monitoring service. Other embodiments described below are designed to guard multiple points of pool entry, provide additional or alternative alarms, and be mounted in various locations.

For those embodiments in which the housing unit 16 is mounted outdoors, the housing unit 16 is preferably formed of a material that is substantially waterproof and resistant to weather conditions. Therefore, suitable plastics, composites, and metals are advantageously used because they do not absorb moisture and generally do not degrade when exposed to weather conditions. Furthermore, it is preferable to utilize materials that do not react when exposed to traditional pool chemicals, such as, for example, chlorine, bromine, and other cleaners.

The housing unit 16 is advantageously constructed such that that the openings formed therein are substantially watertight, especially for outdoor use. The housing unit 16 contains electronics that are particularly sensitive to moisture. Therefore, it is advantageous that the housing unit 16 is substantially watertight. This may be accomplished by providing a seal, such as a gasket, around the openings in the housing, such as the opening for the reset switch 26 and the opening for the internal siren 24. In this way, the siren 24 and reset switch 26 are accessible from without the housing unit 10 while harmful moisture and other contaminants are inhibited from entering the housing unit 16.

Some swimming pool safety regulations require that security measures are constantly active. In response, many pool owners install locks that require a key for entering and/or exiting the pool area. However, keys are easily lost and inventory control can be difficult. Furthermore, gates or doors may be inadvertently left open after an authorized entrance into the pool area, thus allowing unauthorized entry, such as by unattended children.

An alarm constructed in accordance with the present invention overcomes these inherent disadvantages of key-operated locks by incorporating a reset switch 26 that sounds an alarm if a pool entry point has been inadvertently left open.

In operation, as a point of pool entry is opened, the sensor 14 sends a signal to circuitry contained within the housing unit 16 that determines whether or not to sound an audible alarm according to preprogrammed logic instructions. For example, once a gate is opened, an entrant has a fixed amount of time, such as 10 seconds, to depress the reset button 26 or else the alarm is sounded to alert of unauthorized entry. The reset button 26 is preferably positioned out of reach of smaller children so that they cannot reach the button even if they know its function. As another example of the logic instructions, if the pool entrance is not closed within a predetermined amount of time, for example, 10 seconds, the alarm sounds alerting that the pool entrance has been inadvertently left open. In this way, once a pool access point is opened, the alarm will sound unless the reset button 26 is depressed and the pool entrance has been closed.

Figure 2:
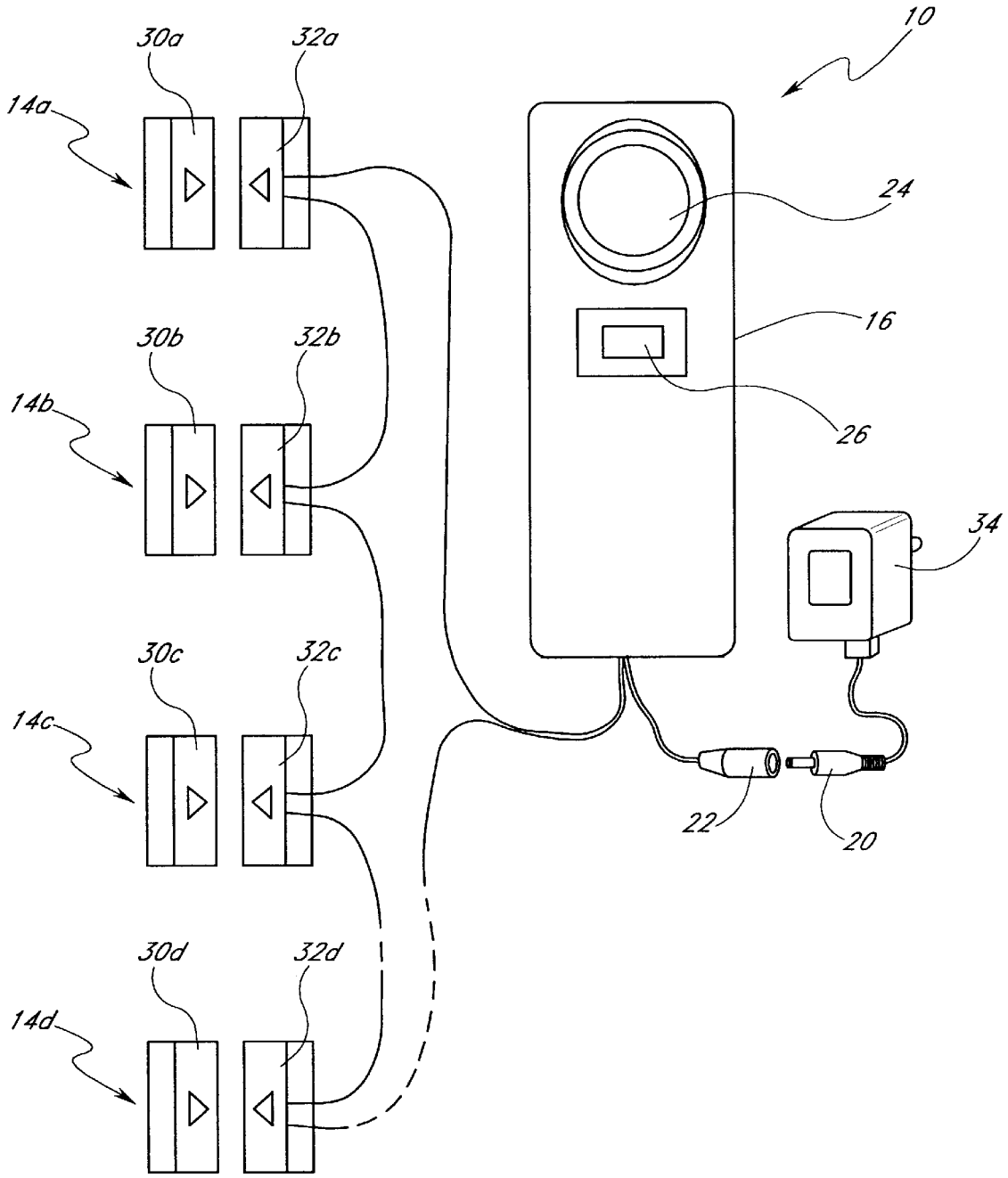
FIG. 2 illustrates an alternative embodiment of a pool guard alarm having a plurality of sensors.

FIG. 2 illustrates an alternative embodiment of a pool guard alarm in which a plurality of sensors 14*a*–14*d* are depicted. In this embodiment, each switch 32*a*–32*d* is connected to the circuitry contained within the housing unit 16 and has an associated magnet 30*a*–30*d*. In one embodiment, each switch 32*a*–32*d* is wired in series such that any interruption in the magnetic field of any of the sensors 14*a*–14*d* is detected. As an alternative, the switches 30*a*–30*d* could each be wired in parallel such that the circuitry could determine precisely which pool access point has been opened. Additionally, a siren could be associated with each pool access point to audibly alert which access point has been opened. Alternatively, audible signals from a single siren could be configured to alert which pool access point has been opened. It should be apparent that any number of sensors 14*a*–14*d* could be coupled to the alarm 10. However, electrical signals deteriorate with increased wire length, and hence, a wire length of 10 meters or less between sensors is preferable, with 10 or fewer sensors. However, the power could conceivably be increased to operate a greater number of sensors over a longer wire length.

As illustrated in FIG. 2, the power is provided by an AC/DC converter 34 which operatively connects to a DC input jack 22 connected to the circuitry located within the housing unit 16. The total wire distance from the power converter 34 to the housing unit 16 is preferably less than about 6 meters, although lengths that exceed 6 meters are entirely possible, and the wire length ultimately depends on the power output from the power converter 34 to account for transmission line losses.

In addition to the requirements that pool safety measures remain continually active, some pool safety regulations require that each point of pool entry is secured. To that end, the illustrated embodiment provides multiple sensors that can be attached to each door, window, or gate that lead to a pool area. Thus, a single pool alarm system 10 can provide adequate pool security by monitoring all possible pool access points.

In addition to offering the functionality of allowing a single pool alarm 10 to secure multiple points of pool entry, the pool alarm system 10 offers the flexibility of being able to be mounted either indoors or outdoors. When the housing unit 16 is mounted indoors, a person entering the pool area depresses the reset button 26 either after, or shortly before, opening the pool access point. This way, the housing unit 16 may be located indoors, and someone desiring to enter the pool area can depress the reset switch, and then open the pool access point and enter the pool area without being required to perform the steps in a specified order. However, the pool alarm 10 still monitors for the closing of the pool access point, and sounds the alarm if the entrance has not been closed within the predetermined amount of time. This configuration additionally allows someone to exit the pool area either before or shortly after depressing the reset button 26.

Figure 3:
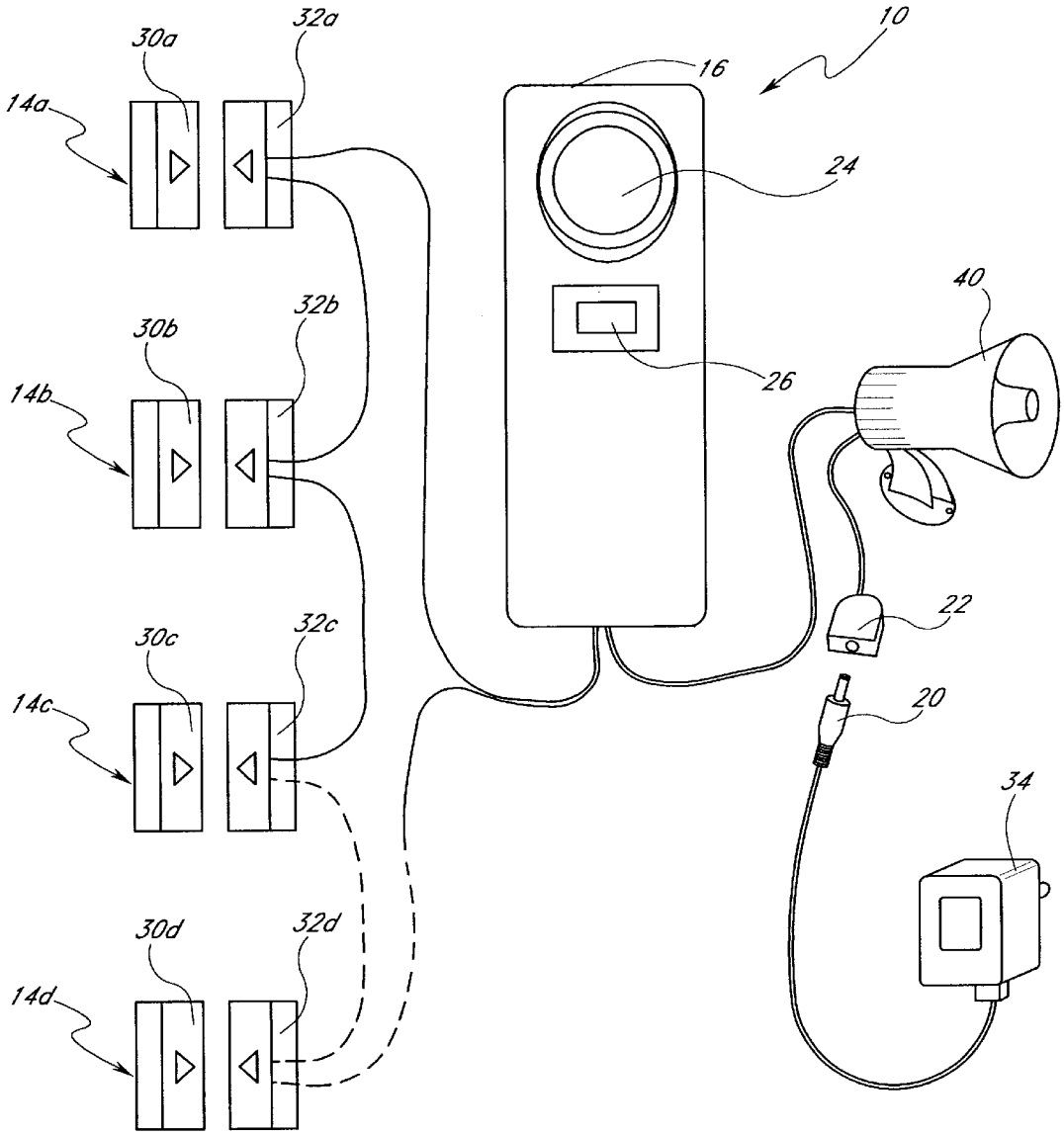
FIG. 3 illustrates yet another embodiment of a pool guard alarm having a plurality of sensors and an external speaker.

FIG. 3 illustrates another embodiment of a pool guard alarm having an external siren 40. The external siren 40 is provided either as a replacement for, or in addition to, the internal siren 24 contained within the housing unit 16. The external siren 40 is designed to emit a high intensity audible signal to alert of either an unauthorized pool entry or an open pool access point. The siren 40 may be used in conjunction with the internal siren 24 by locating the siren 40 outside and the internal siren 24 inside, or vice versa. In this way, an audible signal is broadcast in multiple locations to provide an increased chance that a responsible person will be alerted to a potentially dangerous situation.

As illustrated, the power converter 34 terminates in a plug 20 that fits within a DC jack 22. In some embodiments, the DC jack 22 could be coupled to the siren 40, while in other embodiments the DC jack 22 may be directly connected to the circuitry contained within the housing unit 16. Providing an external siren 40 in addition to the internal siren 24 will generally require more power to adequately drive both sound emitters. Therefore, the power converter may supply increased electrical power. In one embodiment, power is supplied at 12VDC at a current of about 300 mA. The siren 40 and the internal siren 24 may be configured to emit any of a variety of audible signals such as, for example, a steady pitch sound wave, a frequency oscillating sound wave, an amplitude oscillating sound wave, or may be configured to emit pre-recorded speech messages. Of course, other sound wave configurations are possible. Additionally, visual alerts, such as flashing lights, may be used in addition or in alternative to the audible signal.

In an embodiment in which the sensors 14*a*–14*d* are connected in parallel to the circuitry within the housing unit 16, the circuitry can detect which specific point of pool entry has been opened and then activate different audible signals corresponding to the specific point of pool entry triggering the alarm. The audible alarm is controlled by logic circuitry that includes preprogrammed instructions for determining the occurrence of conditions that trigger the alarm.

Figure 4:
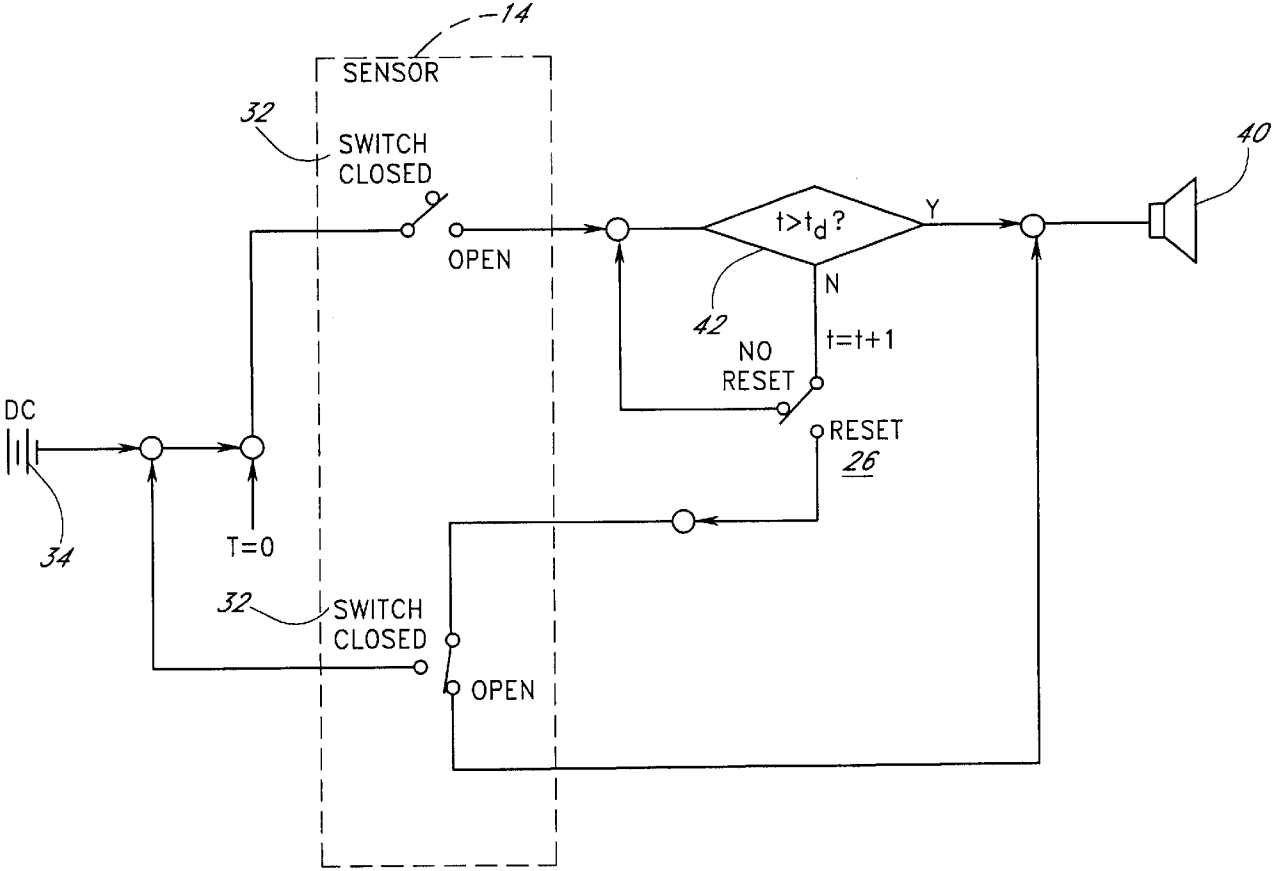
FIG. 4 is a simplified schematic according to one embodiment of a pool guard alarm, illustrating the time delay circuitry for resetting the timer within a prescribed period of time following opening of a pool entry point and for ensuring the entry point is closed within that time.

The logic conditions of the pool guard alarm 10 are illustrated in a simplified schematic of FIG. 4. Upon opening of the switch 32, i.e. displacing the magnet 30 from close proximity to the switch 32, the magnetic field between the magnet 30 and switch 32 of the sensor 14 is interrupted, which toggles a switch in the alarm circuit to indicate opening of a point of pool entry. A timing mechanism 42 measures the elapsed time, t, before the reset button 26 is depressed. If a certain allowable delay time, $t_d$, such as, for example, 10 seconds, passes without reset, then an audible alarm signal is activated. In one embodiment, the sound amplitude is about 110 decibels (db), but may be greater or less depending on the specific application. The timing mechanism 42 may be of a quartz or other simple counter type known to those of ordinary skill in the art.

In addition to detecting the opening of a pool access point, the alarm system 10 may be able to detect the restoration of the magnetic field between the magnet 30 and switch 32, indicating a complete closure of the point of pool entry. If the sensor 14 does not detect this closure, then the elapsed time t is measured and the alarm 40 is activated if the elapsed time exceeds the allowed time $t_d$. That is, if the point of pool entry is not closed within 10 seconds after opening, regardless of whether or not the reset button 26 has been depressed, the alarm 40 is sounded. In this way, a point of pool entry left open will trigger the alarm 40 even if the reset button 26 is pressed within the allowed time $t_d$.

Figure 5:
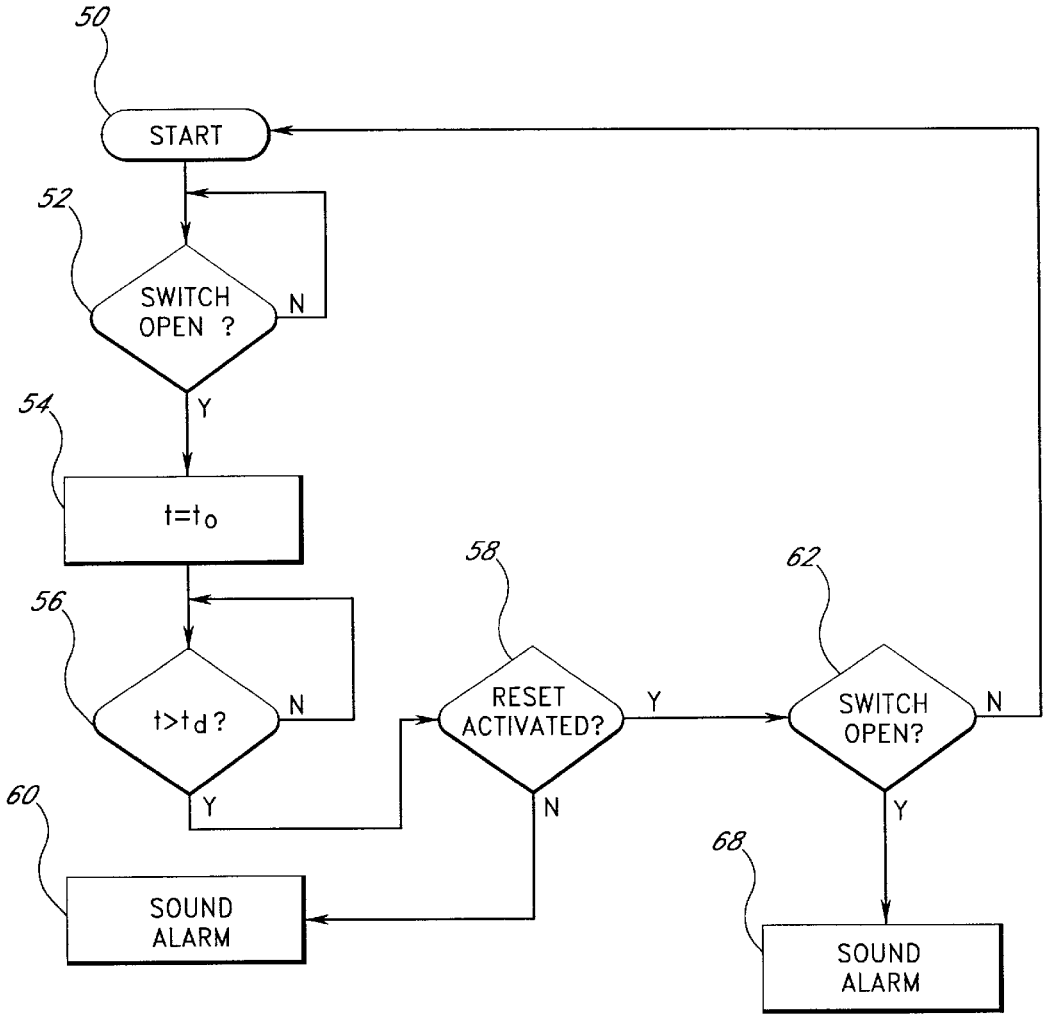
FIG. 5 is a flowchart illustrating one embodiment of the control parameters of a logic circuit that activates an audible alarm signal.

FIG. 5 illustrates the logic instructions of the circuitry contained within the housing unit 16. Initially, power is provided to the circuit and a logic routine starts 50. The circuitry receives signals from each of the sensors 14 and detects when a switch is open at step 52. If no switch has been opened, the logic circuit returns to its initial state and idly waits for a switch to be opened. When an open switch is detected, the counter is initialized and begins counting as shown at step 54. A preprogrammed delay time $t_d$, such as, for example, 10 seconds, is compared with the elapsed time at step 56. When the elapsed time exceeds the delay time, the logic circuit then determines if the reset button 26 has been depressed at step 58. If the reset button 26 has not been depressed, then the alarm is sounded at step 60. If, however, the reset button 26 has been depressed, the logic circuit then determines if the switch is still open at step 62. If the switch is still open, the alarm is sounded. If, however, the switch is closed prior to the delay time elapsing, the system is reset to its initial state 50 and monitors for an open switch.

Thus, the logic circuit detects the opening of a point of pool entry and then sounds the alarm unless certain criteria are met. Specifically, the alarm is sounded unless the reset button 26 is depressed and the point of pool entry is closed within a specified time period. The result is a pool security system that protects multiple points of pool entry and alerts to both unauthorized entry and open pool access points. The system is continually powered by household current and no batteries that must be periodically replaced are required. Moreover, an optional external siren can be positioned to emit an audible signal to locations that may have difficulty receiving the audible signal from the internal siren.

While the foregoing description has been limited to specific preferred embodiments, it should be appreciated that variations therefrom are anticipated without departing from the full spirit and scope of the present invention. Thus, while the invention has been described herein with reference to certain preferred embodiments, these embodiments have been presented by way of example only, and not to limit the scope of the invention. Accordingly, other embodiments and changes in form and detail may be made therein by one skilled in the art without departing from the spirit and scope of the invention, including embodiments which do not provide all of the benefits and features set forth herein.

What is claimed is:

1. An alarm for securing a pool area, comprising:

a plurality of sensors each configured to detect when a separate point of pool access has been opened;

a delay timer operatively coupled to said sensor;

an audio emitter coupled to said timer;

an AC power source operatively coupled to said sensor, timer, and audio emitter for providing electrical power thereto;

a reset switch for resetting said delay timer;

a housing configured to contain said delay timer, audio emitter, and reset switch; and wherein said alarm is configured to detect the opening of each pool access point and activate an audible signal unless both said reset switch has been activated and said pool entry point has been closed.

2. The alarm according to claim 1, wherein said sensors comprise a magnet and a magnet sensor, said magnet sensor configured to detect the presence or absence of said magnet from within close proximity to said magnet sensor.

3. The alarm according to claim 1, further comprising circuitry having instructions for receiving a signal from said sensor, activating said delay timer, and activating said audio emitter.

4. The alarm according to claim 1, wherein said sensors are operatively coupled to said delay timer through wireless transmissions.

5. The alarm according to claim 1, wherein said delay timer is configured to detect the passing of a predetermined amount of time.

6. The alarm according to claim 5, wherein said predetermined amount of time is between about 5 and 20 seconds.

7. The alarm according to claim 6, wherein said predetermined amount of time is about 10 seconds.

8. The alarm according to claim 1, wherein said housing is comprised of ultraviolet and water resistant plastic.

9. The alarm according to claim 1, wherein said power source is household current.

10. The alarm according to claim 1, wherein said plurality of sensors each send corresponding signals to said circuitry.

11. The alarm according to claim 10, wherein the plurality of sensors are connected in a series circuit with said circuitry.

12. The alarm according to claim 1, further comprising an external siren coupled to said circuitry and configured to provide an audible signal.

13. An alarm for securing a pool area, comprising:

a plurality of sensors each configured to detect when a separate point of pool access has been opened;

a delay timer operatively coupled to said plurality of sensors;

an audio emitter coupled to said delay timer;

a power source operatively coupled to said plurality of sensors, timer, and audio emitter for providing electrical power thereto;

a reset switch for resetting said delay timer;

a housing configured to contain said delay timer and reset switch; and wherein said alarm is configured to detect the opening of a pool access point and activate an audible signal unless both said reset switch has been activated and said pool entry point has been closed.

14. A method of guarding a pool area from unauthorized entry comprising the steps of:

providing an alarm system having an audio emitter, a delay timer, and a reset switch;

providing a plurality of sensors operatively coupled to said alarm system, each of said plurality of sensors located at a separate pool entry point;

providing AC power to the alarm system and said plurality of sensors;

sensing the opening a pool entry point;

counting a predetermined amount of time; and activating said audio emitter unless said reset switch has been activated and said pool entry point has closed.

* * * * *